US010019876B2

(12) United States Patent
Fruchard et al.

(10) Patent No.: US 10,019,876 B2
(45) Date of Patent: Jul. 10, 2018

(54) LIGHT AND SOUND SIGNALLING DEVICE

(71) Applicant: Schneider Electric Industries SAS, Rueil-Malmaison (FR)

(72) Inventors: Bertrand Fruchard, L'Isle d'Espagnac (FR); Francis Chauvet, Mouthiers (FR)

(73) Assignee: SCHNEIDER ELECTRIC INDUSTRIES SAS, Rueil Malmaison (FR)

( * ) Notice: Subject to any disclaimer, the term of this patent is extended or adjusted under 35 U.S.C. 154(b) by 0 days.

(21) Appl. No.: 15/451,977

(22) Filed: Mar. 7, 2017

(65) Prior Publication Data

US 2017/0309141 A1 Oct. 26, 2017

(30) Foreign Application Priority Data

Apr. 21, 2016 (FR) ..... 16 53526

(51) Int. Cl.

| | |
|---|---|
| ***G08B 7/06*** | (2006.01) |
| ***F21K 9/68*** | (2016.01) |
| ***F21V 33/00*** | (2006.01) |
| ***G10K 9/122*** | (2006.01) |
| ***F21V 15/01*** | (2006.01) |

(Continued)

(52) U.S. Cl.

CPC ..... *G08B 7/06* (2013.01); *F21K 9/68* (2016.08); *F21V 15/01* (2013.01); *F21V 23/005* (2013.01); *F21V 33/00* (2013.01); *F21V 33/0052* (2013.01); *G10K 9/122* (2013.01); *F21V 23/0435* (2013.01); *F21V 31/00* (2013.01); *F21V 33/0056* (2013.01);

(Continued)

(58) Field of Classification Search

CPC ... G08B 7/06; F21K 9/68; F21V 15/01; F21V 33/00; F21V 33/0052; F21V 23/005; G10K 9/122

See application file for complete search history.

(56) References Cited

U.S. PATENT DOCUMENTS

| | | | | |
|---|---|---|---|---|
| 5,374,876 | A | 12/1994 | Horibata et al. | |
| 2009/0196016 | A1* | 8/2009 | Massara | F21V 23/0471 362/86 |

(Continued)

FOREIGN PATENT DOCUMENTS

| | | | |
|---|---|---|---|
| CN | 102330921 | A | 1/2012 |
| CN | 202281167 | U | 6/2012 |
| EP | 1 650 722 | A2 | 4/2006 |

OTHER PUBLICATIONS

French Preliminary Search Report dated Jul. 21, 2016 in French Application 16 53526 filed on Apr. 21, 2016 (with English Translation of Categories of Cited Documents and Written Opinion).

*Primary Examiner* — Leon Flores

(74) *Attorney, Agent, or Firm* — Oblon, McClelland, Maier & Neustadt, L.L.P.

(57) ABSTRACT

The invention relates to a signalling device comprising a cover, a light source (22) mounted on a support circuit board (20) and a vibrating generator (25, 26) intended to emit sound waves, the cover forming an outer wall (11) that is at least partly translucent, characterized in that:

- the light source (22) is positioned between the vibrating generator (25, 26) and the outer wall (11);
- the cover comprises a connecting column (12) that passes through the support circuit board (20) and to which the vibrating generator (25, 26) is fixed.

12 Claims, 2 Drawing Sheets

(51) Int. Cl.

| | |
|---|---|
| ***F21V 23/00*** | (2015.01) |
| *F21V 31/00* | (2006.01) |
| *F21V 23/04* | (2006.01) |
| *F21W 111/00* | (2006.01) |
| *F21W 131/403* | (2006.01) |
| *F21Y 115/10* | (2016.01) |
| *F21Y 105/18* | (2016.01) |

(52) U.S. Cl.
CPC .... *F21W 2111/00* (2013.01); *F21W 2131/403* (2013.01); *F21Y 2105/18* (2016.08); *F21Y 2115/10* (2016.08)

(56) References Cited

U.S. PATENT DOCUMENTS

| | | | | |
|---|---|---|---|---|
| 2010/0123595 | A1 | 5/2010 | Shain et al. | |
| 2010/0135021 | A1* | 6/2010 | Tuan ..... | G09F 9/33 362/249.05 |
| 2012/0235828 | A1 | 9/2012 | Bronowicz et al. | |
| 2014/0355246 | A1 | 12/2014 | Yotsumoto et al. | |

* cited by examiner

LIGHT AND SOUND SIGNALLING DEVICE

TECHNICAL FIELD OF THE INVENTION

The present invention relates to a light and sound signalling device, for example a light-up buzzer, intended in particular for use in monitoring and control systems for industrial process automation or building automation.

PRIOR ART

In a known manner, indicator lights or light-up push-buttons exist which are additionally capable of emitting a sound. They are referred to for example as light-up buzzers or acoustic indicator lights. They comprise a body surmounted by a generally circular head bearing the light and sound elements and they may be mounted on enclosure panels or on man-machine dialogue stations, for example through a standardized opening of 22 mm in diameter.

The lighting portion generally comprises one or more light sources, preferably composed of LEDs (light-emitting diodes) which are mounted on a support, for example a printed circuit board. The light is subsequently transmitted to the outside through an outer wall of the indicator light/button, this wall being at least partly translucent.

The acoustic portion generally comprises a vibrating generator, for example a piezoelectric generator. The vibrating generator is capable of being deformed through the action of an AC voltage so as to generate a vibration which produces a sound. In order to transmit this sound, a simple architecture exists in which the vibrating generator is fixed to the outer wall of the indicator light/button, such that the vibration is transmitted to the outer wall and the sound then becomes easily audible for an operator located in proximity.

An advantage of this architecture is that it avoids any piercing of the outer wall of the product for the purpose of better transmitting the sound and therefore allows the obtention of a sealed acoustic indicator light/button with a very high level of ingress protection (IP), for example IP65 or even IP69, which is demanded in certain industrial applications.

However, a drawback of this architecture is that it restricts the positioning of the LEDs to below the vibrating generator on the periphery of the button such that they are not able to emit light directly to the top of the indicator light/button but only to the sides of the vibrating generator and therefore indirectly illuminate the indicator light/button. The luminosity of the indicator light/button is then severely diminished.

The document CN202281167U furthermore describes a light and sound button in which a buzzer is fixed inside the button and is extended at one end by a cavity that terminates at the front of the button, such that the sound of the buzzer is transmitted through the air to the outside. Such a button therefore comprises an opening on its front face, causing it not to be sealed and impeding the transmission of light through a portion of its front face.

One aim of the invention is therefore to overcome the above problems and hence to obtain a sealed light-up buzzer having both good luminous and acoustic capabilities while remaining simple and economical to design and produce.

SUMMARY OF THE INVENTION

This aim is achieved by a signalling device comprising a cover, a light source mounted on a support circuit board and a vibrating generator intended to emit sound waves, the cover forming an outer wall that is at least partly translucent.

The light source is positioned between the vibrating generator and the outer wall and the cover comprises a connecting column that passes through the support circuit board and to which the vibrating generator is fixed, such that the vibrations of the vibrating generator are directly transmitted to the cover.

According to one feature, the light source comprises one or more light-emitting diodes. According to one feature, the vibrating generator comprises a piezoelectric transducer mounted on a deformable pad. According to one feature, the pad is substantially circular in shape and comprises reinforcements at its periphery allowing its inertia to be increased. The vibrating generator may be bonded to the end of the connecting column.

According to one feature, the connecting column is located about a central axis of the signalling device and the support circuit board comprises a central hole to allow the connecting column to pass therethrough.

According to one feature, the vibrating generator also serves as a light reflector capable of reflecting the light emitted by the light source.

According to one feature, the signalling device also comprises a communication antenna positioned between the vibrating generator and the outer wall. The communication antenna may be fixed to the support circuit board.

According to one feature, the signalling device comprises a body to which the cover is fixed, and the support circuit board is placed at one end of the body.

BRIEF DESCRIPTION OF THE FIGURES

Other features and advantages will appear in the following detailed description given in conjunction with the appended drawings in which.

DETAILED DESCRIPTION

Figure 1:
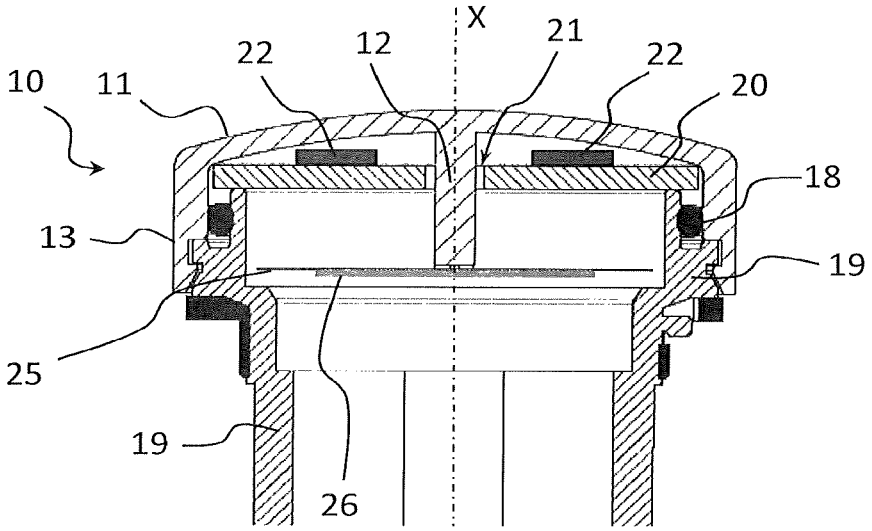
FIG. 1 shows a cross-sectional view of a first embodiment of an indicator light according to the invention.

FIG. 1 shows a view along a longitudinal cross section of a light and sound signalling device according to the invention. The signalling device comprises a head 10 which is mounted on a body 19. The body 19 may be made of a metal material or of a plastic material according to the type of device. The head 10 comprises a cover 11 which forms a continuous, at least partly translucent outer wall 11 of the device, such that light is transmitted to the outside of the signalling device. In a known manner, the outer wall of the cover generally has a circular cross section and is extended by a lateral extension 13 that at least partially surrounds the body 19 so that it can be fixed to the body 19. The seal between the body 19 and the cover 11, 13 may additionally be reinforced by an O-ring 18. In the example shown in the figures, the outer wall of the cover is concave in overall shape, but it could also be convex or planar in shape. The connections of the signalling device with the outside (control and electrical power supply circuits) are made from the body 19 and are not shown in the figures.

The lighting portion of the signalling device comprises a light source which is composed of two LEDs 22 in the example shown. These two LEDs 22 are mounted on a support circuit board 20 of printed circuit board type. Preferably, these two LEDs 22 are components of SMD (surface-mount device) type soldered to the support circuit board 20. The support circuit board 20 may of course bear other electronic components, in particular those allowing the light source to be controlled. In order to optimize the luminosity of the signalling device, it is of course advantageous to position the LEDs facing the outer wall of the cover without obstacles between the two.

The acoustic portion of the signalling device comprises a vibrating generator comprising a transducer of piezoelectric type 26 fixed to a deformable pad 25 that exhibits elasticity, since it may be deformed through the action of the transducer but return to its original shape when the action of the transducer ceases, such as would be observed in a spring. The piezoelectric transducer 26 is capable of being deformed through the action of a voltage and hence of deforming the pad 25. By reversing the polarity of this voltage, the transducer 26 is deformed in the opposite manner. Thus, when the applied voltage is an AC signal, the transducer+pad assembly generates a vibration and this vibration produces a sound. Preferably, the AC signal is a square signal but it could also be a sinusoidal signal. For the sake of simplicity, the electrical conductors allowing the AC signal to be transmitted to the piezoelectric transducer are not shown in the figures.

In order to transmit the sound generated by the vibrating generator and to make it easily audible for an operator located in proximity to the signalling device, the pad+transducer assembly 25, 26 should be fixed to the cover of the signalling device, such that the vibration is directly transmitted to the cover. For this purpose, the outer wall 11 of the cover is extended by a connecting column 12 which passes through the support circuit board 20 via an opening 21 and to which the vibrating generator 25, 26 is fixed. This connecting column 12 must be light and rigid so that the vibrations generated during the application of an AC voltage to the vibrating generator are efficiently transmitted to the cover. The vibrating generator may be fixed to the column 12 for example by bonding the end of the connecting column 12 to the pad 25.

Thus, the light source and its support circuit board may be intercalated between the outer wall and the vibrating generator. By virtue of this solution, both good acoustic efficiency and good luminous efficiency are afforded, since the sound is transmitted directly to the cover and the light source emits directly towards the cover without obstacle. Advantageously, the cover therefore requires no opening or hole in order to transmit sound, thereby allowing the signalling device to be sealed.

The connecting column 12 may be a separate part which is bonded to the cover comprising the outer wall 11 and the lateral extension 13. Alternatively, the cover may comprise only one translucent moulded part comprising the connecting column 12, the outer wall 11 and the lateral extension 13, which simplifies the manufacture of the signalling device.

The signalling device is preferably designed so that the vibrating generator is fixed solely to the connecting column 12 and therefore comprises no other fixation point, thereby further increasing the efficiency of the vibrating generator.

The pad 25 is preferably made of a metal material of low thickness (for example of the order of 0.1 mm) but may also be made using a ceramic or plastic material that is rigid enough to be able to vibrate. It is preferably circular and, as shown in the figures, larger in size than the piezoelectric transducer 26.

Figure 4:
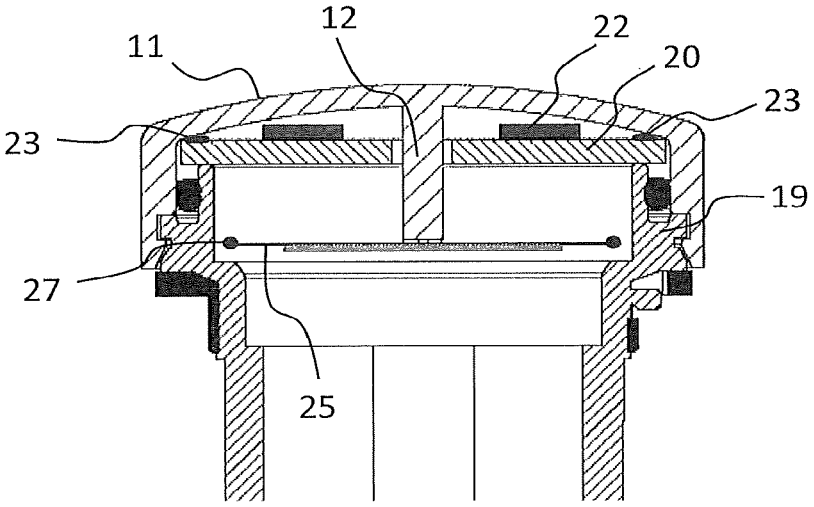

The resonant frequency of a piezoelectric transducer is proportional to its thickness and inversely proportional to the square of its diameter. In this instance a relatively low sound frequency is desired, for example of the order of 2000 to 3000 Hz. For this purpose, it is therefore preferable for the pad 25 to be as wide and as thin as possible. Moreover, an acoustic power of the order of 80 to 90 dB at a distance of 10 cm from the signalling device is desired. In order to increase the acoustic power, FIG. 4 shows one variant in which the circular pad 25 comprises, at its periphery, a reinforcement 27 which allows the inertia of the pad, and hence the acoustic power, to be increased.

Preferably, the connecting column 12 is central, i.e. located about a longitudinal central axis X of the signalling device, and the support circuit board 20 comprises a central hole 21 of sufficient size to allow the column 12 to pass therethrough. The LEDs 22 are placed on either side of the connecting column 12. Having a central connecting column 12 makes it possible to fix the circular pad 25 by its centre and therefore to interfere less with the vibrations of the pad.

The light source could equally be composed of one or more LEDs according to the luminous power and consumption desired for the signalling device. Likewise, a solution other than a transducer assembly of piezoelectric type fixed to a deformable pad could be envisaged for the vibrating generator, such as for example a solenoid with a magnet.

In the example of FIG. 1, the support printed circuit board 20 is placed on top of the ends of the body 19 and, more particularly, rests on the ends of the body 19, such that the light source 22 is placed as closely as possible to the translucent outer wall 11 in order to optimize the luminosity of the signalling device.

Figure 2:
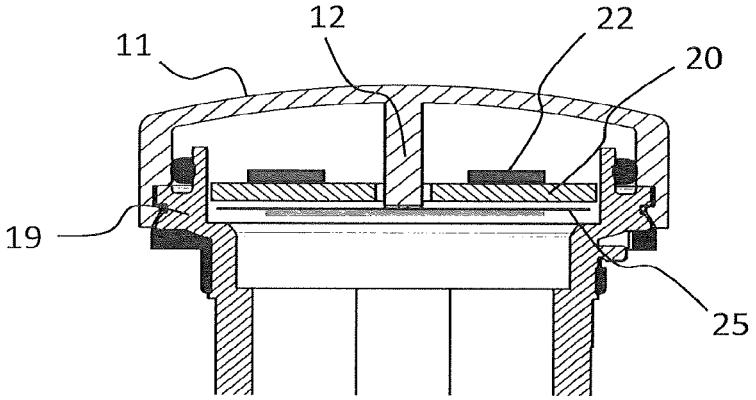
FIGS. 2, 3 and 4 show cross-sectional views of a second, third and fourth embodiment, respectively.

FIG. 2 reprises the features of FIG. 1, except that the support circuit board 20 is not positioned on the ends of the body 19 but instead is inserted between the ends of the body 19, thereby allowing the support circuit board 20 to be set slightly away from the outer wall 11 and hence more space to be left for positioning a light source 22, which is potentially bulkier if need be, while retaining dimensions and positioning that are similar to those of the pad 25.

Figure 3:
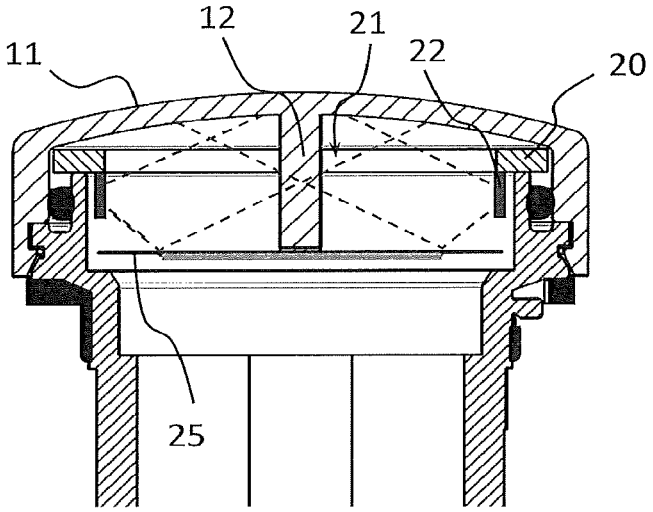

In the variant shown in FIG. 3, rather than the light source being positioned between the support circuit board 20 and the outer wall 11 of the cover as in FIGS. 1 and 2, it is the support circuit board 20 which is positioned between the light source and the outer wall of the cover 11. Thus, the LEDs 22 are mounted below the support circuit board 20 so as to be able to emit both towards the outer wall and towards the pad 25. For this purpose, the support circuit board 20 takes, for example, the form of a crown which is positioned on the body 19 with a central hole 21 of substantial size, such that the luminous flux emitted by the LEDs 22 passes through this central hole 21 before directly or indirectly hitting the outer wall of the cover 11.

In this configuration, the vibrating generator therefore also serves as a light reflector capable of reflecting the light emitted by the light source. The pad 25 is reflective, thereby allowing the light emitted by the LEDs 22 to be reflected back towards the outer wall 11 of the cover and hence to the outside. For this purpose, the pad 25 is for example covered by a reflective paint or by a metallized or chrome coating. Thus, by virtue of this variant, the vibrating generator helps to reflect the luminous flux emitted by the light source, thereby allowing the uniformity and the transmission of the light as seen by an external operator to be enhanced by limiting existing light spot effects produced by the LEDs when they emit only directly towards the outer wall of the cover 11.

Furthermore, by virtue of the invention, the signalling device may advantageously also incorporate an interface allowing wireless communication to take place between the signalling device and an external unit. Such wireless communication may be used in particular for parametrizing and configuring, in a simple manner, the operating modes of the signalling device from an external unit (programming the ramp-ups, levels and types of sound sequences, the intensities and colours of the light source, identification for acknowledging or stopping the sound emission, etc.).

FIG. 4 thus shows one embodiment in which the signalling device comprises an antenna 23 allowing this wireless communication, this wireless communication possibly being for example of RFID (radiofrequency identification) type and, more particularly, of NFC (near-field communication) type. In order to carry out this type of communication, it is preferable for the antenna to be placed as far forward as possible in order to limit the effect of surrounding metal parts. The antenna 23 is therefore fixed in the vicinity of the periphery of the support circuit board 20. It is composed of one or more circular turns. A few turns (for example four to five for an antenna diameter of the order of 25 mm) are sufficient for an antenna with this type of wireless communication.

Thus, since the support circuit board 20 is placed above the vibrating generator and above the body 19 (i.e. on the one hand between the vibrating generator 25, 26 and the outer face of the cover 21 and, on the other hand, between the body 19 and the outer face of the cover 21), the metal parts that the vibrating generator and the body 19 may contain do not interfere with the antenna 23. In order to decrease interference further still, the antenna could additionally be equipped with a shield also positioned on the support circuit board 20.

The invention claimed is:

1. A signaling device, comprising:

a cover that forms a continuous outer wall and that includes a connecting column that passes through a support circuit board;

a vibrating generator that emits sound waves and that is fixed to the connecting column; and a light source that is mounted on the support circuit board and that is positioned between the vibrating generator and the continuous outer wall, wherein the continuous outer wall is at least partly translucent, and vibrations, caused by the sound waves emitted by the vibrating generator, are directly transmitted through the connecting column.

2. The signaling device according to claim 1, wherein the light source comprises one or more light-emitting diodes.

3. The signaling device according to claim 1, wherein the vibrating generator comprises a piezoelectric transducer mounted on a deformable pad.

4. The signaling device according to claim 3, wherein the deformable pad is substantially circular in shape and comprises reinforcements at its periphery allowing its inertia to be increased.

5. The signaling device according to claim 1, wherein the connecting column is located about a central axis of the signaling device and the support circuit board comprises a central hole to allow the connecting column to pass therethrough.

6. The signaling device according to claim 1, wherein the vibrating generator is bonded to the end of the connecting column.

7. The signaling device according to claim 1, wherein the vibrating generator is fixed solely to the connecting column.

8. The signaling device according to claim 1, wherein the vibrating generator also serves as a light reflector that reflects the light emitted by the light source.

9. The signaling device according to claim 1, further comprising a communication antenna positioned between the vibrating generator and the outer wall.

10. The signaling device according to claim 9, wherein the communication antenna is fixed to the support circuit board.

11. The signaling device according to claim 1, further comprising a body to which the cover is fixed, and the support circuit board is placed at one end of the body.

12. The signaling device according to claim 1, wherein the vibrations are directly transmitted to the continuous outer wall through the connecting column.

* * * * *